United States Patent [19]

Traub et al.

[11] Patent Number: 5,022,649

[45] Date of Patent: Jun. 11, 1991

[54] QUICK CHANGE DEVICE FOR A BASKETBALL HOOP

[75] Inventors: Barry H. Traub, Dunwoody, Ga.; Emile Leoni, Brampton, Canada

[73] Assignee: Select Service & Supply Co., Inc., Atlanta, Ga.

[21] Appl. No.: 395,844

[22] Filed: Aug. 18, 1989

[51] Int. Cl.[5] ..... A63B 63/08

[52] U.S. Cl. ..... 273/1.5 R; 248/222.1; 248/222.2

[58] Field of Search ..... 273/1.5 R, 1.05 A; 248/222.1, 222.2; 108/153, 157, 159

[56] References Cited

U.S. PATENT DOCUMENTS

| | | | |
|---|---|---|---|
| 1,522,957 | 1/1925 | Kennedy | 273/1.5 R |
| 2,427,335 | 9/1947 | Antonia et al. | 248/222.2 |
| 3,970,304 | 7/1976 | Ebstein et al. | 273/1.5 R |
| 4,583,732 | 4/1986 | Allen | 273/1.5 R |
| 4,613,135 | 9/1986 | Rush | 273/1.5 R |

*Primary Examiner*—Paul E. Shapiro

*Attorney, Agent, or Firm*—Browdy and Neimark

[57] ABSTRACT

A basketball quick change hoop assembly is shown and described. A board mounting adaptor plate having flanges on its vertical edges engages vertical channel sides of a hoop mounting member. Slots at the top of the flanges receive extensions from the hoop mounting member.

21 Claims, 2 Drawing Sheets

FIG. 1
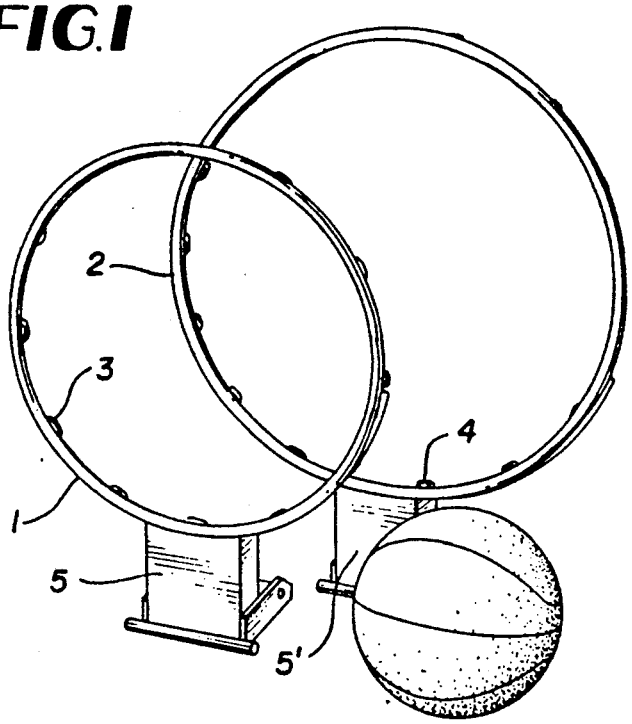
FIG. 2
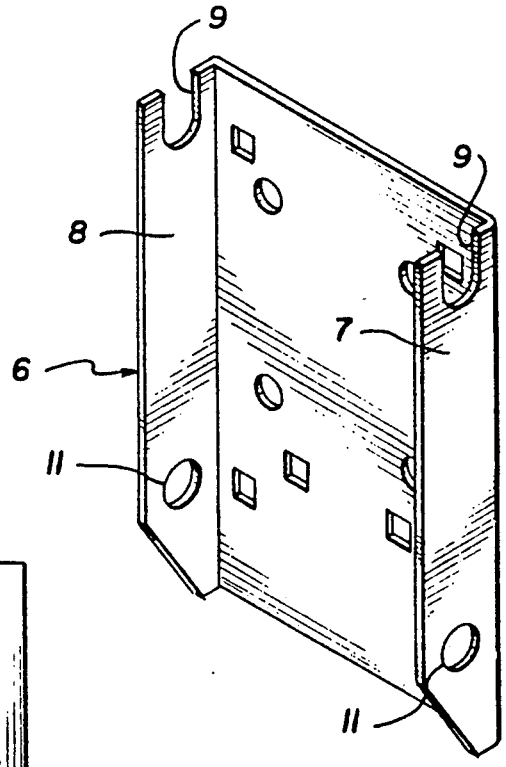
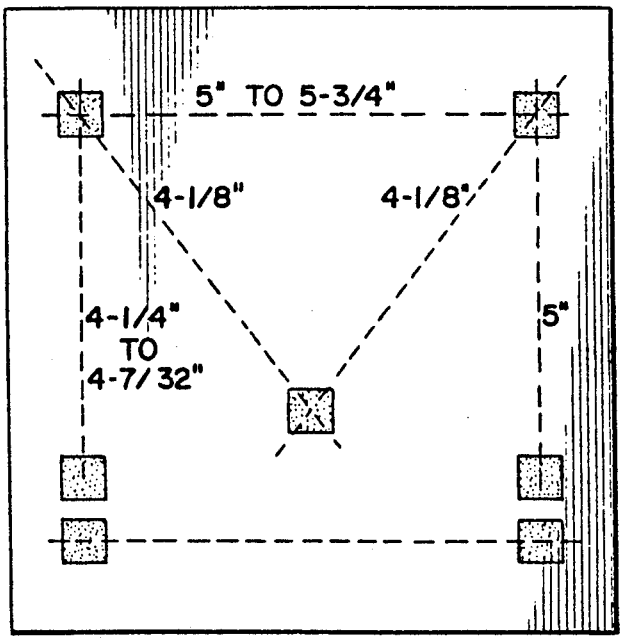
FIG. 3

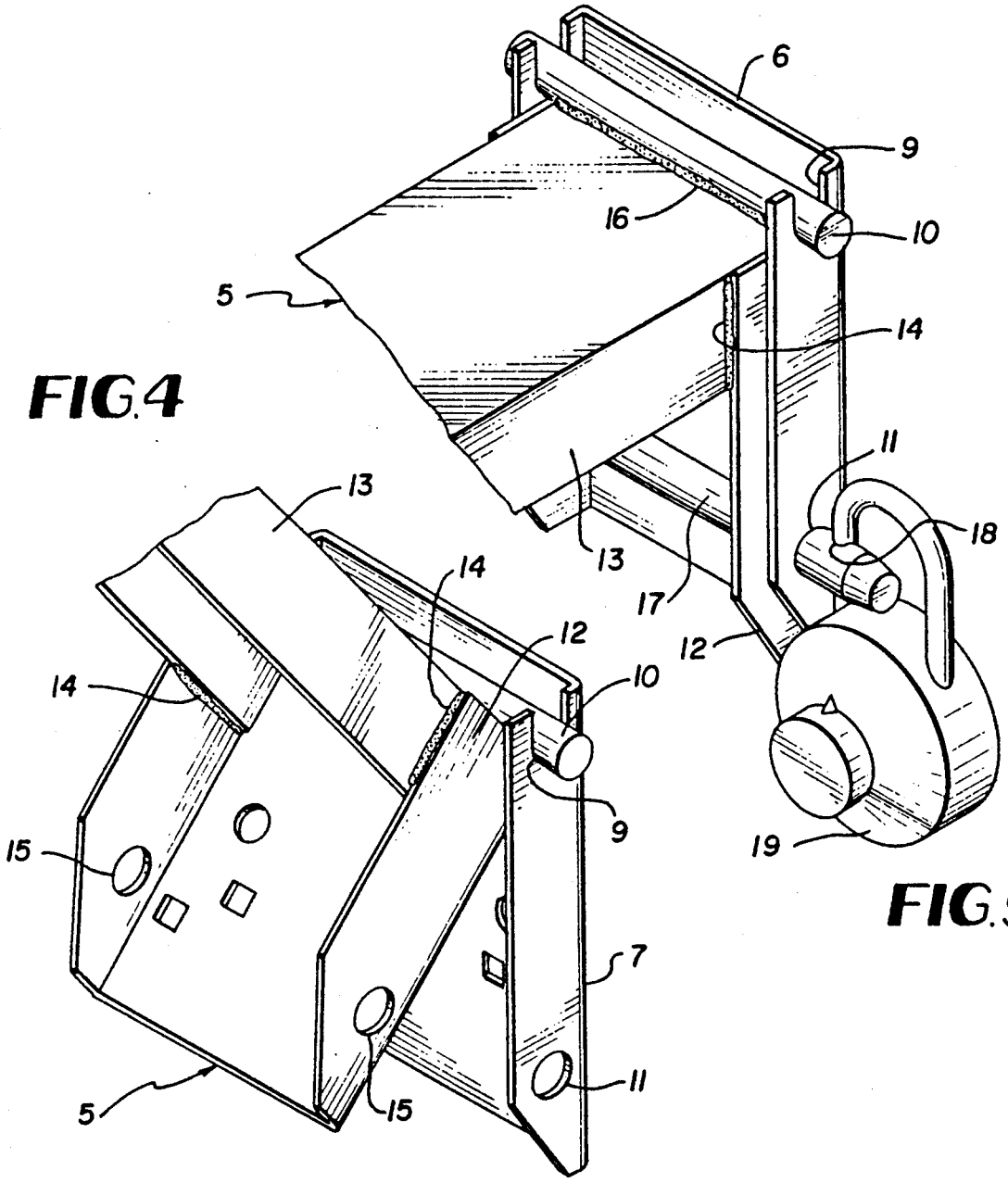
FIG.4
FIG.5
FIG.6
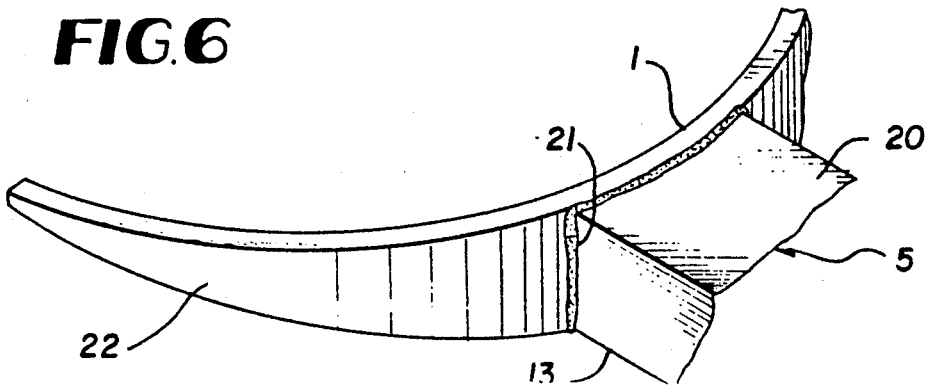

QUICK CHANGE DEVICE FOR A BASKETBALL HOOP

FIELD OF THE INVENTION

This invention relates to basketball goals, and more particularly, basketball goals which may be quickly and more easily mounted on a backboard or similar support. The invention relates to improvements in mounting of basketball goals in which a quick change means allows mounting of two of more different types of basketball goals so that a change of goals type may be quickly made.

BACKGROUND OF THE INVENTION

It has been found that basketball hoops which have a standard 18" hoop diameter are too difficult for children or persons just learning the game of basketball. Therefore, in public parks, public gymnasiums, or other institutional facilities, it has become desirable to provide basketball hoops which are not standard, such as hoops which are 22½" in diameter instead of the normal 18". This enlarged diameter allows the basketball to pass more freely through the goal and therefore provide a higher success rate to the novice basketball player.

In order to provide for maximum utilization of such institutional public facilities, it is desirable to provide a means whereby the standard 18" hoop may be quickly substituted for the nonstandard large size hoop. The apparatus to permit this quick change should be constructed so that a change is quick, and so that a minimum of effort is required on the part of the person making the change.

In the prior art known to the applicant, U.S. Pat. No. 4,613,135 Rush, shows a quick change device for a basketball goal, and teaches that larger than standard size goals may be used for novice basketball players. However, the goal of the '135 patent teaches construction of a quick change device which provides a tongue member 40 and a longitudinal slot 42 fixed to a goal mounting member 38. The tongue 40 is inserted into a guide channel 22 formed by a black back plate 16 and guide members 20. The Rush design also uses a lug 18 and wing nut 52 for holding the assembly together. The Rush device however is not suitable for institutional uses because the use of the wing nut is not reliable, the device cannot be locked together, and the mounting plate 16 is necessarily limited in hole patterns by the configuration of the guide channel 22 and guide members 20.

SUMMARY OF THE INVENTION

The primary object of this invention is to provide a basketball goal system with interchangeable goals, which is simple in construction, is easy to install, and convenient in use. It is another object of this invention to provide a rigid, sturdy yet simple, changeable mounting system for alternating goals to be used within basketball.

It is another object of this invention to provide a goal which interchangeable, and at the same time which is safe, and which can withstand the stress received in an institutional facility or public playground.

In this invention a board mounting adaptors plate having flanges on each side is bolted through a basketball backstop. The board mounting plate may have a plurality of holes or different hole patterns which permit mounting on a plurality of different standard hold patterns found in basketball backboard mounting systems. The mounting plate of this invention has flanges on each vertical side which extend outwardly from the backboard and toward the basket or playing court.

A hoop mounting member which is constructed with two different sizes of channel iron is welded to a rim and to a rim reinforcing section. The two channels are at a 90° angle, and one of these channels rests within the face by the board mounting adaptor plate flanges. The vertical channel rests within these flanges, and is fixed to the flanges by a means of a bar welded to the top of the hoop mounting member and which rests in "U" shape slots on the top of said flanges. This fixes the top of the hoop mounting in all, axes except for vertical movement upward. The bar welded across the top of the mounting member essentially forms extensions which extend towards the board mounting plate flanges.

A lower rod is used to pin the vertical rim mounting channel to the board mounting plate flanges. This pin is merely a rod extended through aligned holes in the channel and the flanges. The rod may be fixed at the outer end of one side with any suitable clip which could extend through a hole drilled through the top of the rod. A lock may also be placed through a hole upon this rod tip to prevent theft of the otherwise easily removable basketball hoop and hoop mounting member.

In this invention, the horizontal spacing member is a channel having an end inserted between the sides of said vertical rim mounting channel, and the rim mounting channel is inserted between the flanges of the mounting plate.

The horizontal spacing member is designed so that the distance from the back of the rim to the backboard is a standard 5½". The plate as viewed from the top is the same as any standard basketball horizontal spacing member, but viewed from the sides it is seen to be a channel providing rigidity to the horizontal section, and a vertical surface upon which to mount a semicircular hoop brace which reinforces the weld at the junction of the hoop and the horizontal spacing member.

The board mounting plate or adaptor plate is intended to be bolted to a backboard, to permit rapid changing of goals from a standard 18" regulation size to an oversize 22½" goal. The goal is also drilled with a universal hole configuration back plate so it can mount to any institutional backboard without the use of the adaptor plate or mounting plate.

The 22½" goal size diameter is 25% larger than the regulation 18". In order to maintain the spacing between the net hooks, the 22½" goal is provided with 15 net hooks instead of standard number 12 which are used on an 18" rim.

With the larger goal, beginning basketball players, children, and elderly and handicapped people are able to score more goals. The higher success rate of goal making in turn encourages players and reinforces their success.

In the system of this invention the purchaser of the hoop mounting member has the option of bolting the hoop mounting member directly to a backboard by means of standard located holes in the back plate of the hoop mounting member, or attaching the hoop mounting member to a board mounting adaptor plate which has been previously bolted to the backboard.

BRIEF DESCRIPTION OF THE DRAWINGS

FIG. 1 shows a standard 18" hoop and an oversized 22.5" hoop constructed in accordance with this invention.

FIG. 2 shows a board mounting adaptor plate which may receive different size hoops.

FIG. 3 shows a hole pattern designed to accept a plurality of standard hole patterns used to mount basketball hoops to boards.

FIG. 4 shows a board mounting plate and hoop mounting member being assembled.

FIG. 5 shows a perspective view of a board mounting adaptor plate and a hoop mounting member in the completed assembled position.

FIG. 6 shows a hoop spacing "U" shape channel member assembled with the hoop and a hoop reinforcing brace.

DETAILED DESCRIPTION OF THE PREFERRED EMBODIMENT

In FIG. 1 there is shown a first standard 18" hoop 1 which is mounted to a hoop mounting member 5 in accordance with this invention. Similarly, an oversize 22½" hoop 2 is mounted to a second hoop mounting member 5'. The hoop mounting members 5,5' are interchangeable, on the adaptor plate 6 shown in FIG. 2.

The hoops also include no tie net holders 3 and 4. In the case of the 18" hoop 1, the standard number of 12 no-tie holders is used, while in the larger hoop, the number of ties is increased from 12 to 15 and the net is made corresponding larger. This increase from 12–15 maintains the same spacing from net tie to net tie around the hoop, and therefore, the same overall appearance.

In FIG. 2 there is shown a board mounting adaptor plate, fixed to a board, which has flanges 7,8 mounted on each vertical side. The flanges 7,8 have "U" shaped slots 9 in the top for receiving a mounting bar 10 of the hoop mounting member. The board mounting plate also includes holes 11 which are located towards the bottom of the flanges and which receive a locking bar 17 which holds the final assembly together. The board mounting adaptor as shown in FIG. 2 has four bolts extending through the plate and into a mounting surface of a backboard. The bolt hold pattern on the board mounting adaptor plate is selected so that the plate will fit a plurality of standard backboard hold patterns which are known in the industry.

In FIG. 3, there is shown a layout of typical bolt hole patterns which may be used with the board mounting adaptor plate, or which may be used with the hoop mounting member when there is no use of an adaptor plate. Both the adaptor plate, and the hoop mounting member are drilled with patterned holes so that either may be mounted directly to a standard hole pattern in a backboard.

In FIG. 4 there is shown a board mounting adaptor plate 7 and a hoop mounting member having a rod 10 attached to its top. These parts in FIG. 4 are shown as they are being assembled with the rod 10 set into the "U" shape slot 9 of the adaptor 7. Although a rod is shown, any other protrusion or extension from the hoop mounting member which engages an upwardly extending shape slot in the adaptor plate flange may be used.

The hoop mounting member 5 is constructed of a vertical section of a steel channel 12 which is slightly narrower than the distance between the flanges 7,8 of the board mounting adaptor plate 7. The hoop mounting member at channel 12 has on its rearward surface the standard hole pattern depicted in FIG. 3 for direct attachment to a backboard. The channel 12 is in turn welded to a second channel 13 which extends horizontally outward from the backboard, and perpendicular to channel 12. The channel 13 is built of channel iron which is slightly smaller than the spacing between the inside faces of the channel 12. Channel 12 and channel 13 are assembled by welding at their corners and other suitable weld points such as 14. The channel 12 has hole 15 drilled through its bottom section on the channel sides which are located so as to be aligned with holes 11 in the board mounting adaptor plate when the hoop mounting member is assembled to the adaptor.

In FIG. 5 there is shown a perspective view of the hoop mounting member 5 assembled to the board mounting adaptor plate 6. The steel rod 10 is shown resting in "U" slot 9. The rod 10 is shown welded at the top of the channel 13 at weld 16. The rod 10 rests at the bottom of the "U" 9, and the primary weight of the unit is carried at this location. Located at the bottom of the assembly is a bolt or rod 17 which extends through holes 11 and 12 in the vertical flanges and the hoop mounting member channel 12. This bolt locks the assembly together, and prevents removal of the hoop mounting member and the basketball hoop assembly.

The bolt 17 includes a hole 18 at its tip for receiving a pin or lock 19. Other hold down devices at the bottom of the flange 7 and the channel 12 may be used. If the holes 11 and 15 are drilled close to the edge of the channels, a lock may be placed directly through the channels and the use of the bolt eliminated. Other methods of securing the two together at the bottom can be devised by those skilled in the art.

The rod 10 shown in FIG. 5 and FIG. 4 is a first rod which lies generally across the top of the hoop mounting member, and the rod 17 is a second steel rod which lies at the bottom of the assembly and fits through aligned holes in the board mounting plate adaptor and vertical channel of the mounting member.

In FIG. 6 there is shown a detailed sketch of the attachment of the hoop 1 to the channel 13. Channel 13 also comprises the horizontal spacing member 20 which gives the spacing from the back of the hoop to the backboard. This spacing on the standard basketball assembly is approximately 5.5 inches. The sides of the channel 13 terminate in a vertical cut 21 to which a hoop support 22 is welded. The hoop support 22 is also welded to the rim, and the combination of the support 22, the vertical section 21, and the hoop form a welded triangular brace which supplies substantial strength to the rim assembly 1 which is also welded to the spacing member 20.

The apparatus providing for change of hoop mounting member and rims is intended to be marketed in a number of ways. The board mounting adaptor plate, and the hoop mounting members with hoops may be sold separately. If they are sold separately, either the board mounting adaptor plate or the hoop mounting member can be bolted directly to the backboard. If a board mounting adaptor plate is used, then the rim may be rapidly removed or replaced on the mounting bracket. If a single rim is used, the quick change feature of this invention allows easy removal of rims for non-playing seasons, such as the winter in outdoor basketball courts, or in the gym when other activities are planned. The quick change feature provides for exchanging of standard size rims and over size rims to change the degree of difficulty of making basketball shots.

This item may be marketed as a package which would include a board mounting adaptor plate, a standard size hoop and mounting member, and a nonstandard over size hoop and mounting member. In this package the user may rapidly switch rims back and forth to accommodate different types of play.

For institutional purposes, where many hoops and basketball facilities are present, there may be any combination of a number of standard size and over size hoops which can be used with adaptor plates.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A quick change device for holding a basketball hoop comprising a combination:

a board mounting plate having flanges on each vertical side of said plate, said flanges extending in the direction of said hoop;

a hoop mounting member comprising a horizontal spacing member, and a vertical rim mounting channel which is fixed to said hoop horizontal spacing member; and means for attaching said vertical rim mounting channel to said mounting plate flanges.

2. The apparatus in claim 1 wherein said hoop mounting member has extensions which extend towards said board mounting plate flanges and engage said flange.

3. The apparatus of claim 2 wherein a "U" shaped slot is cut in the top of each of said flanges and said extensions engage said "U" shape slots.

4. The apparatus of claim 3 further comprising a bottom attaching means for attaching said hoop mounting member to said board mounting plate flanges at a point below said "U" shape slots.

5. The apparatus in claim 1 wherein said means for attaching said vertical rim channel to said mounting plate flanges comprises;

a "U" shaped slot cut in the top of each of said flanges; and a first rod which is fixed to the top of said hoop mounting member and which extends through said "U" shaped slots of said vertical rim mounting channel sides.

6. The apparatus of claim 5 further comprising a bottom attaching means for attaching said hoop mounting member to said board mounting plate flanges at a point below said "U" shaped slots.

7. The apparatus of claim 6 wherein said bottom attaching means is more than half way from said "U" shaped slots to the opposite end of said flange.

8. The apparatus of claim 7 wherein said bottom attachment means comprises a second rod member which extends through aligned holes in said vertical rim mounting channel sides and in said board mounting plate flanges.

9. The apparatus of claim 8 wherein said second rod member has a head at one end and a hole in the other end to receive a pin.

10. The apparatus of claim 9 wherein said pin is a loop of a padlock.

11. The apparatus of claim 1 wherein said hoop horizontal spacing member is welded to said vertical rim mounting channel.

12. The apparatus of claim 1 wherein said hoop is welded to said horizontal spacing member.

13. The apparatus of claim 1 wherein a semi-circular hoop brace is welded to said spacing member and to a portion of said hoop.

14. The apparatus in claim 13 wherein said hoop brace is welded to a vertically extended portion of said horizontal spacing member.

15. The apparatus of claim 1 further including means for mounting said mounting plate to a wall surface.

16. The apparatus of claim 1 wherein said horizontal spacing member is a channel having an end inserted between the sides of said vertical rim mounting channel, and said rim mounting channel is inserted between the flanges of said mounting plate.

17. The apparatus of claim 1 wherein said hoop mounting member has a plurality of holes through it which enable alignment with a plurality of different hole patterns in a back board.

18. The apparatus of claim 1 wherein said horizontal spacing member is a channel.

19. The apparatus of claim 18 wherein said horizontal spacing member channel lies within the sides of said vertical rim mounting channel.

20. The apparatus of claim 19 further including a first rod which is fixed to the top of said horizontal spacing member channel for engaging "U" shape slots cut into the top of said board mounting plate flanges.

21. A basketball hoop set comprising in combination:

a board mounting plate having flanges on each vertical side of said plate, flanges extending in the direction of a hoop when mounted on said flanges; a plurality of hoop mounting members comprising each a single spacing member, a vertical rim mounting channel which is fixed to said horizontal spacing member; and means for attaching each of said vertical rim channels to said mounting plate flanges.

* * * * *